United States Patent [19]

Sinnema

[11] 4,065,238

[45] Dec. 27, 1977

[54] APPARATUS FOR MANUFACTURING MOLDED ARTICLES FROM A KNEADABLE MATERIAL, E.G., CLAY

[75] Inventor: Hendrik Sinnema, Sneek, Netherlands

[73] Assignee: Machinefabriek W. Hubert & Co. B.V., Sneek, Netherlands

[21] Appl. No.: 780,947

[22] Filed: Mar. 24, 1977

Related U.S. Application Data

[62] Division of Ser. No. 541,035, Jan. 14, 1975.

[51] Int. Cl.[2] ..... B28B 13/02

[52] U.S. Cl. ..... 425/94; 425/202; 425/297; 425/449

[58] Field of Search ..... 425/297, 301, 202, 305 R, 425/296, 308, 94, 257, 449; 83/651.1, 307.1, 307.2

[56] References Cited

U.S. PATENT DOCUMENTS

| | | | |
|---|---|---|---|
| 61,238 | 1/1867 | Nulsen et al. | 425/202 |
| 541,642 | 6/1895 | Traiser | 425/202 |
| 786,003 | 3/1905 | Codding | 83/651.1 X |
| 1,664,372 | 3/1928 | Mohr | 425/297 |
| 2,301,906 | 11/1942 | Miller et al. | 425/297 X |
| 2,389,163 | 11/1945 | Miller et al. | 425/449 X |
| 2,450,437 | 10/1948 | Miller | 425/363 X |
| 2,843,081 | 7/1958 | Wilson | 425/94 X |
| 3,451,107 | 6/1969 | Cummings | 425/202 X |

FOREIGN PATENT DOCUMENTS

| | | | |
|---|---|---|---|
| 460,807 | 5/1928 | Germany | 425/297 |

OTHER PUBLICATIONS

Singer et al., Industrial Ceramics, p. 717, publ. 1963.

*Primary Examiner*—Francis S. Husar
*Assistant Examiner*—William R. Briggs
*Attorney, Agent, or Firm*—Alan H. Levine

[57] ABSTRACT

Apparatus by which moulded articles are manufactured from clay, a continuously produced strand of the material in question is sprinkled with sand, whereafter at one location a piece is severed from the end of the strand at regular intervals, by a cutting apparatus, which piece then enters a mould. In the course of all phases of the process the strand and each severed piece thereof remain directed along one vertical downwardly directed line of movement.

6 Claims, 3 Drawing Figures

APPARATUS FOR MANUFACTURING MOLDED ARTICLES FROM A KNEADABLE MATERIAL, E.G., CLAY

BACKGROUND OF THE INVENTION

This application is a division of application Ser. No. 541,035, filed Jan. 14, 1975.

My invention relates to an apparatus for manufacturing moulded articles from kneadable or plastic materials, e.g. clay, for sprinking a continuously produced strand of the material in question with a granular material e.g. sand, whereupon at the end of the advancing strand at one location at regular intervals a piece is severed therefrom and such a velocity is imparted to the severed piece that, when the latter enters a mould which is put in readiness, as a consequence of the kinetic energy accumulated in said severed piece, it automatically fully fills the mould.

SUMMARY OF THE INVENTION

My invention aims to provide an improvement of this apparatus known per se, which is achieved by the arrangement that in the course of all phases of the process the strand and each severed piece thereof are directed or remain directed along only one vertical or at least practically vertical line of movement. The effect of this improvement is that the complete apparatus required for performing said process occupies less floor space while the operation reliability increases. In order to avoid a deviation from the direction of movement on severing a piece from the end of the strand, each periodical cutting of the continuously produced advancing strand of kneadable material is effected from two lateral faces of the strand, which are symmetrically situated relative to the direction of movement. This simultaneous cutting is preferably effected from two lateral faces of the strand along circular segmental paths which contact or intersect each other in the strand. Consequently the severed piece of the strand is prevented from tilting owing to the action of the cutters which would, as a matter of fact, occur should the cutting be effected from one side only. When circular mental paths are applied the severed piece is formed with an arrow-shaped profile, which also assists in keeping the piece in the vertical direction of movement.

The cutting also relates to the cutting apparatus required for performing the process as described apparatus is provided with two shafts which are rotatably supported on either side of the advancing strand and provided with driving means for rotation, at least one cutter being mounted on each shaft, in a direction parallel to the shaft, the driving means being constructed and arranged such that the shafts rotate in opposite directions with an equal circumferential velocity, a cutter on either side of the continuously advancing strand penetrating periodically at the same time into the strand. On each shaft an equal number of cutters are likewise arranged in the same way about said shaft, the cutters preferably consisting of cutting wires.

Figure 1:
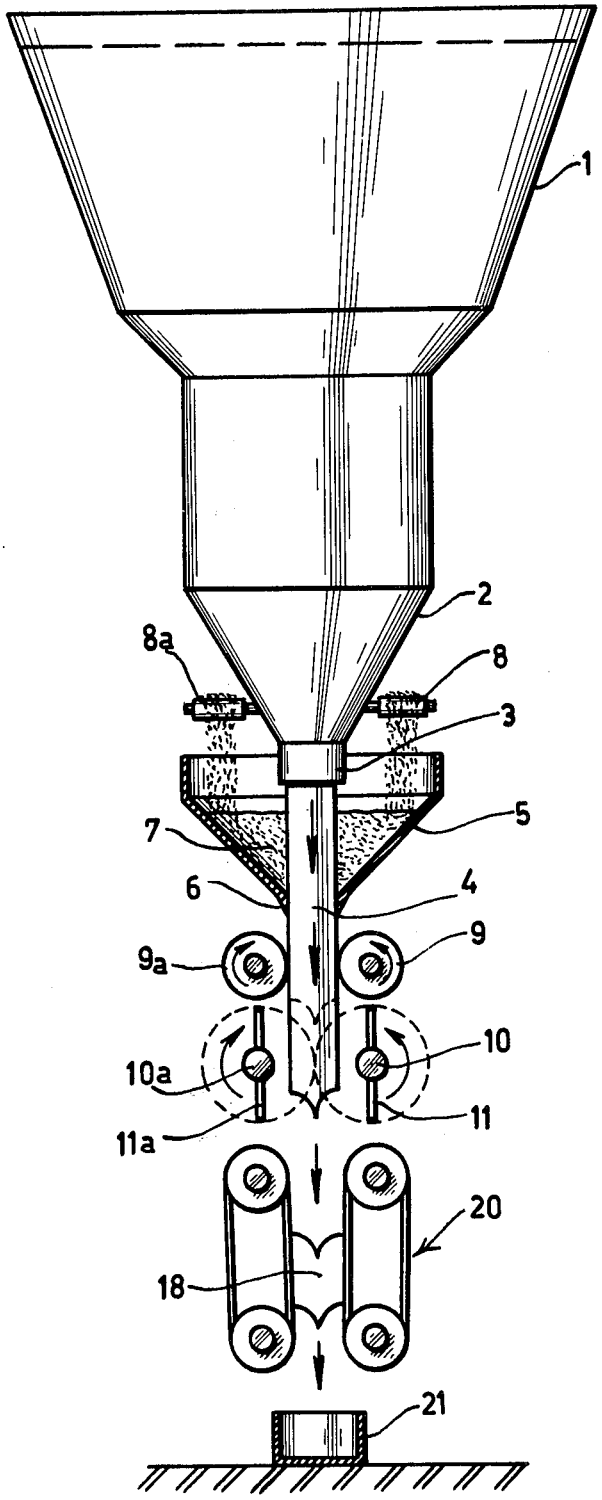
FIG. 1 represents diagrammatically a view of the apparatus for manufacturing the moulded articles.

DESCRIPTION OF PREFERRED EMBODIMENTS:

The apparatus for manufacturing the moulded articles from a kneadable material, e.g., consists of a container 1 with a hopper-shaped end piece 2 ending in an outlet 3. By means of members (not shown) the kneadable mass is continuously pressed through the outlet 3 so as to issue therefrom as a vertically advancing strand 4 of kneadable material. Around the outlet 3, is disposed a sanding box 5, with an opening 6, situated vertically under the outlet 3, the cross section of said opening 6 corresponding to the cross section of the extruded strand 4. The sanding box 5 is regularly filled up with a quantity of sand 7 which is supplied via endless belts 8 and **8*a* from a container (not shown). Vertically spaced down from the passage 6 are two pairs of presser rollers, of which one pair of rollers 9 and 9*a* is visible in FIG. 1. Each presser roller is applied to a corresponding lateral face of the strand 4**.

By means of driving members (not shown) the presser rollers 9 and **9*a* of each pair of rollers are rotated in opposite directions, consequently the sand applied to the strand 4** is pressed into the same.

Figure 2:
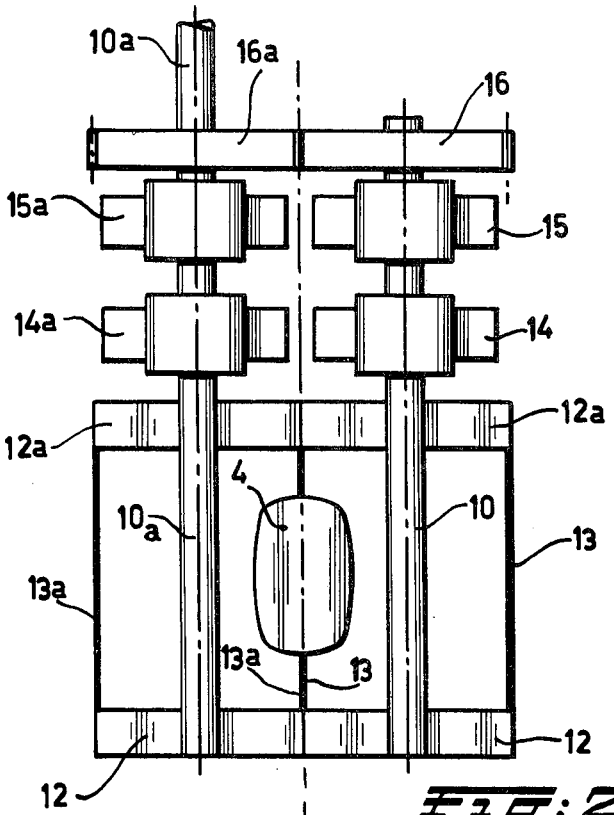
FIG. 2 shows on a larger scale a plan view of the cutting apparatus.

Mounted vertically under the pairs of presser rollers 9 and **9*a* is a cutting apparatus consisting of two cutters 11 and 11*a* mounted on either side of the advancing strand 4 on corresponding rotatably supported shafts 10 and 10*a*. Each cutter 11 or 11*a* consists of two arms 12 and 12*a* which in spaced relationship from each other are secured on the shaft of the cutter and which are situated in the same plane parallel to each other. Each arm extends perpendicular to the shaft on either side thereof and equally far (see also FIG. 2). A cutting wire 13 or 13*a* is mounted between the ends of a pair of arms 12 or 12*a*** situated on one side of the shaft.

The shafts 10 and **10*a* which are unilaterally supported in a double pair of bearings 14 and 15, 14*a* and 15*a*, respectively, are rotated in opposite directions at the same speed. The driving gear therefor consists of gear wheels 16 and 16*a*, secured on the respective shafts 10 and 10*a*, which are in mesh, while the shaft 10*a*** is coupled to a driving motor (not shown).

Figure 3:
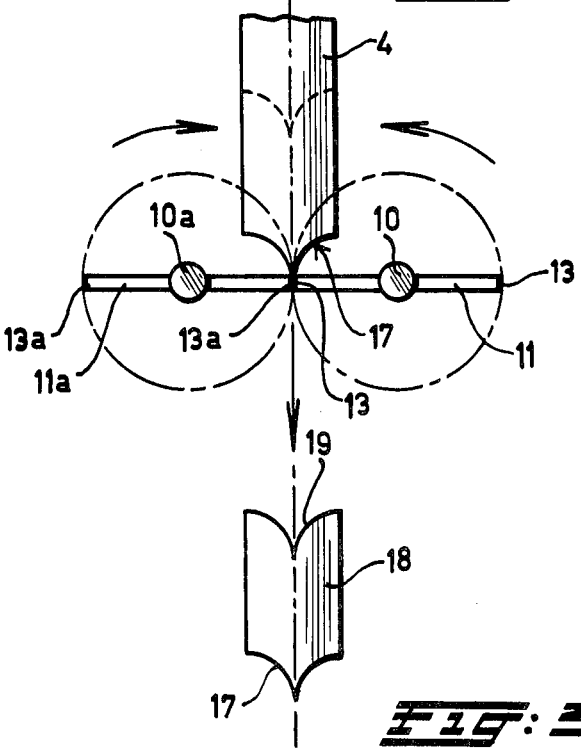
FIG. 3 shows diagrammatically a front view of the cutting apparatus, part of the advancing strand entering the cutting apparatus, and part of a severed piece after leaving the cutting apparatus.

The dimensions and the adjustment of the cutting members 11 and **11*a* are such relative to each other that on either side of the continuously advancing strand 4 cutting wires periodically penetrate simultaneously into the strand 4 cutting from two sides through this strand along circular segmental paths, touching each other in the strand. In connection with the fact that the strand 4 keeps moving during the cutting operation, finally a more or less arrow-shaped face of severance 117 is formed (see FIG. 3). Obviously the severed piece 18 of the strand 4 has at its front end the shape of an arrow, while the other end has an indentation 19** the profile of which corresponds to that of the shape of the arrow.

Vertically under the cutting apparatus and spaced therefrom is disposed a guiding device 20 by which means the piece 18, severed from the strand 4 is thrown into the mould 21 at a particular rate.

Various modifications are possible within the scope of the invention, particularly as to the number and the shape of the cutting members to be disposed in the cutting apparatus.

What I claim is:

1. An apparatus for making molded articles comprising:

a. means for continuously producing a vertical strand of plastic material, the strand moving continuously along a vertical path, b. means vertically beneath said strand-producing means for severing the strand at regular intervals to produce a succession of individual pieces of plastic material, c. a mold vertically beneath said strand-severing means, and d. means vertically beneath said strand-severing means and vertically above said mold for receiving each individual piece and for throwing each piece along the vertical path into said mold with sufficient kinetic energy that the piece plastically deforms and fills the mold.

2. An apparatus as defined in claim 1 including means vertically above said strand-severing means for applying sand to the exterior surface of the moving strand prior to severing the strand.

3. An apparatus as defined in claim 2 including means between said sand-applying means and said strand-severing means for pressing the sand into the strand.

4. An apparatus as defined in claim 1 wherein said strand-severing means includes two cutting means arranged on opposite sides of the vertical path, and means simultaneously moving both cutting means into the strand along two lines of severance which extend from opposite sides of the strand and meet in the middle of the strand.

5. An apparatus as defined in claim 4 wherein each cutting means includes a horizontal wire, and said moving means moves each wire through an arcuate path, so that each line of severance has a circular segmental shape which causes the lower end of each individual piece to have an arrowhead-like configmation.

6. An apparatus as defined in claim 1 wherein said throwing means includes a pair of endless belts each having at least one vertical and downwardly-moving run, said vertical runs being spaced apart so as to receive each individual piece between them.

* * * * *